United States Patent [19]

Hiro et al.

[11] Patent Number: 4,877,701

[45] Date of Patent: Oct. 31, 1989

[54] PHOTOSENSITIVE MEMBER FOR ELECTROPHOTOGRAPHY

[75] Inventors: Masaaki Hiro, Ninomiya; Tomohiro Kimura, Yokohama; Hisami Tanaka, Tokyo; Noboru Kashimura, Kawasaki; Shigemori Tanaka, Tokyo; Hitoshi Tohma; Masafumi Hisamura, both of Kawasaki, all of Japan

[73] Assignee: Canon Kabushiki Kaisha, Tokyo, Japan

[21] Appl. No.: 75,654

[22] Filed: Jul. 20, 1987

[30] Foreign Application Priority Data

Jul. 24, 1986 [JP] Japan ..... 61-174153

[51] Int. Cl.[4] ..... G03G 5/14

[52] U.S. Cl. ..... 430/59; 430/58; 430/96

[58] Field of Search ..... 430/58, 59, 96

[56] References Cited

U.S. PATENT DOCUMENTS

| | | | |
|---|---|---|---|
| 4,150,987 | 4/1979 | Anderson et al. | 430/59 X |
| 4,463,077 | 7/1984 | Matsuura et al. | 430/58 X |
| 4,663,259 | 5/1987 | Fujimura et al. | 430/67 X |
| 4,766,048 | 8/1988 | Hisamura | 430/58 |

FOREIGN PATENT DOCUMENTS

| | | |
|---|---|---|
| 0149914 | 7/1985 | European Pat. Off. . |
| 1543763 | 4/1979 | United Kingdom . |
| 2025263 | 1/1980 | United Kingdom . |

*Primary Examiner*—Roland E. Martin

*Attorney, Agent, or Firm*—Fitzpatrick, Cella, Harper & Scinto

[57] ABSTRACT

A photosensitive member for electrophotography which is excellent in successive copying characteristics as well as mechanical durability is provided. The photosensitive member comprises a photosensitive layer, at least the surface portion of which comprises a lubricant, and a charge-transporting substance having an oxidation potential of 0.6 volt or above.

14 Claims, No Drawings

PHOTOSENSITIVE MEMBER FOR ELECTROPHOTOGRAPHY

FIELD OF THE INVENTION AND RELATED ART

The present invention relates to a photosensitive member for electrophotography capable of providing a high-quality image and excellent in durability.

In recent years, as photoconductive materials used in a photosensitive member for electrophotography, various organic photoconductive materials have been developed and used in copying machines or printers. However, photosensitive members using such photoconductive materials, in general, have been poor in mechanical durability or successive copying characteristics, and this has been a serious drawback.

The above successive copying characteristics in electrophotography or successive electrophotographic operation characteristics) include sensitivity, residual potential characteristic, charging characteristics, freeness from image blur, etc., and the above mechanical durability include resistance to wear or scratches caused by rubbing, etc. Among these, the above-mentioned photosensitive member is particularly poor in mechanical durability, which is an important factor affecting the lifetime of the photosensitive member. Accordingly, it has been desired to develop a photosensitive member excellent in the mechanical durability.

Further, the surface of a photosensitive member, particularly under a high-humidity condition, contains factors causing deterioration in image quality such as sticking of low-resistance substance due to ozone produced in corona charging, or toner sticking or "filming" based on insufficient cleaning of toner. Therefore, the photosensitive member surface is required to have releasability to various sticking substances as well as to have the above-mentioned mechanical durability.

Thus, in order to satisfy these requirements, i.e., in order to improve the mechanical durability to wear or scratches and to impart releasability and water-repellency thereby to prevent toner sticking, etc., there has been proposed that it is effective to disperse a lubricant in the surface layer of a photosensitive member, as disclosed in U.S. Pat. No. 4,030,921 and Japanese Laid-Open Pat. Application Nos. 126838/1981 and 14845/1982.

On the other hand, since the surface of a photosensitive member is continuously affected by a deteriorating action due to ozone produced in corona charging, the surface of the photosensitive member must be scraped to constantly expose a new surface, in order to provide high-quality images. Particularly, in a case where the scraping action is insufficient, decrease in image resolution occurs whereby decrease in image clearness, i.e., so-called "image blur" is caused as the number of successive copying increases. Since the conventional photosensitive member is poor in mechanical durability, the surface thereof is appropriately scraped thereby to constantly expose a new surface. As a result, with respect to such conventional photosensitive member, the above-mentioned image blur has hardly been a serious problem in practical use.

However, in the above-mentioned photosensitive member in which a lubricant is dispersed in the surface layer thereof, the mechanical durability is enhanced whereby the degree of scraping at the surface is markedly decreased. As a result, in such photosensitive member, since the deteriorated surface layer cannot be sufficiently scraped, an image blur occurs in successive copying. Therefore, it has been difficult to practically use such photosensitive member although it has bee improved in mechanical durability.

SUMMARY OF THE INVENTION

An object of the present invention is to provide photosensitive member for electrophotography not only having high durability but also satisfying the above-mentioned requirements.

More specifically, an object of the present invention is to provide a photosensitive member for electrophotography which not only has high durability including high resistance to wear or scratches, etc., caused by rubbing at the surface thereof, but also is excellent in successive copying characteristics thereby to provide a high-quality image without image blur.

Another object of the present invention is to provide a photosensitive member for electrophotography excellent in mechanical durability which has good cleaning characteristics and is free from toner sticking at the surface thereof.

A further object of the present invention is to provide a photosensitive member for electrophotography excellent in successive copying characteristics in which residual potential is not elevated, and which can constantly provide a high-quality image during repeated electrophotographic process.

According to the present invention, there is provided a photosensitive member for electrophotography comprising a photosensitive layer, at least the surface portion of which comprises a lubricant, and a charge-transporting substance having an oxidation potential of 0.6 volt or above.

These and other objects, features and advantages of the present invention will become more apparent upon a consideration of the following description of the preferred embodiments of the present invention.

DETAILED DESCRIPTION OF THE INVENTION

In the photosensitive member according to the present invention, a lubricant imparts a lubricative property to the surface thereof and prevents mechanical damage such as wear or scratches in a transfer step wherein a toner image is transferred to paper, or in a cleaning step using, e.g., a cleaning blade. The lubricant further improves releasability or water-repellency to sticking of low-resistance substance, toner filming or sticking of paper powder in corona charging, developing, and transfer steps.

Further, in combination with the above physical effect, the charge-transporting substance having an oxidation potential of 0.6 V or above chemically prevents deterioration at the photosensitive member surface caused by active substances such as ozone, $NO_x$, etc. which may be produced by light, heat or corona charging etc., in repetitive use, thereby to prevent image blur.

As a result, according to the present invention, there is provided a photosensitive member excellent in successive copying characteristics as well as mechanical durability, in which charge carriers are efficiently generated and transported.

A lubricant or lubricating agent used in the present invention may preferably be insoluble in general organic solvents, and may preferably be a resinous substance, more preferably be lubricative resin powder.

Since the interaction between the lubricative resin powder and the charge-transporting substance is considerably weak, the charge-transporting substance is not affected by the resin powder. On the other hand, in a case where the lubricant is not powdery (e.g., soluble in a solvent), since the compatibility of such lubricant with the charge-transporting substance is generally poor, the charge-transporting substance is liable to be deposited as insoluble matter at the surface of the photosensitive layer thereby to cause an image defect.

Preferred examples of the lubricant may include, e.g., lubricative resin powders such as fluorine-containing resin powder, polyolefin resin powder, and silicone resin powder; fluorinated carbon, etc. Among these, fluorine-containing resin powder is particularly preferably used.

More specifically, such fluorine-containing resin powders may include; e.g., tetrafluoroethylene resin powder, trifluorochloroethylene resin powder ethylene-hexafluoropropylene copolymer resin powder, vinyl fluoride resin powder, vinylidene fluoride resin powder, fluorodichloroethylene resin powder, and copolymers of monomers constituting these resins, and the like. In the present invention, one or more species of these resin powders may be appropriately selected and used. Among these, tetrafluoroethylene resin powder, or vinylidene fluoride resin powder is particularly preferably used.

Further, polyolefin resin powders may include: e.g., homopolymer resin powders such as polyethylene resin powder, polypropylene resin powder, polybutene resin powder and polyhexene resin powder; copolymer resin powders such as ethylene-propylene copolymer resin powder, and ethylene-butene copolymer resin powder; terpolymers comprising hexene and a monomer constituting there polymers; and heat-denatured products of these polyolefin resin powders; etc. In the present invention, one or more species of these resin powders are appropriately selected and used. Among these, polyethylene resin powder or polypropylene resin powder is particularly preferably used.

The molecular weight of lubricative resins or the particle size of resin powders may be appropriately selected, but the particle size may preferably be 0.1 - 10 μm. The lubricant such as lubricative resin powder may be contained or dispersed either in the entire photosensitive layer, or in a surface portion thereof. In the latter case, the depth or thickness of the surface portion containing the lubricant may preferably be 2 μm or larger.

In the present invention, a charge-tranporting substance having an oxidation potential of 0.6 V (volt) or above is used. Herein, the term "charge-transporting substance" means a substance having a function of receiving charge carriers generated by a charge-generating substance mentioned hereinafter, and a function of transporting the charge carriers.

The charge-transporting substance used in the present invention may include: e.g., hydrazone compounds, stilbene-type compounds, carbazole compounds, pyrazoline compounds, oxazole compounds, thiazole compounds, triarylmethane compounds, polyaryl alkanes, etc. One or more species of these charge-transporting substances are appropriately selected and used.

As the oxidation potential of the charge-transporting substance becomes higher, deterioration due to ozone, etc., may be prevented more effectively whereby a higher successive copying characteristic may be exhibited. Particularly, in a case where the oxidation potential of the charge-transporting substance is 0.7 V or above, such effect becomes more marked.

In the formation of a photosensitive layer in whic the lubricant is contained or dispersed, when a charg transporting substance having a relatively low molec lar weight and not having a film-formability is used resin having a film-formability may be used as a bind Herein, the film-formability means ability of a resin to form a uniform film from a solution thereof in which the resin is dissolved in a general organic solvent such as hydrocarbons, aromatic hydrocarbons, halogenated hydrocarbons, ketones or esters.

In the present invention, it is preferred to use a binder resin having a certain hardness in itself and not obstructing carrier transportation. More specifically, preferred examples of such binder may include: polymethacrylates, polycarbonates, polyarylates, polyesters, polysulfones, etc.

In a case where such binder is used, the lubricant content in the photosensitive layer may be, based on the weight of the photosensitive layer containing the lubricant, preferably 1 - 50 wt. %, more preferably 2 - 15 wt. %, in view of improving effect on the surface layer, light-transmissibility, carrier mobility, etc.

In a preferred embodiment of the present invention, a photosensitive member for electrophotography comprises an electroconductive substrate and a photosensitive layer disposed thereon, and the photosensitive layer may preferably be functionally separated into a charge generation layer and a charge transportation layer. In such embodiment, the above-mentioned lubricant and the charge-transporting substance having an oxidation potential of 0.6 V or above are contained in the charge transportation layer disposed on the charge generation layer.

In this embodiment, the lubricant content in the charge transportation layer may be, based on the weight of the charge transportation layer containing the lubricant, preferably 1 - 50 wt. %, more preferably 2 - 15 wt. %. The thickness of the charge transportation layer may generally be 5 - 30 μm, preferably 8 - 25 μm, in view of charge carrier transportability.

In a case where the photosensitive layer comprises the functionally separated charge generation layer and charge transportation layer, charge carriers may be transported more efficiently since the trapping of charge carriers is restrained. Further, the mechanical durability of the photosensitive layer may be enhanced since the charge transportation layer covers the charge generation layer containing the charge-generating substance such as a pigment which can be deposited near the surface of the charge generation layer.

The electroconductive substrate having a conductive layer may be a substrate which per se has an electroconductivity such as that of aluminum, aluminum alloy, copper, zinc, stainless steel, vanadium, molybdenum, chromium, titanium, nickel, indium, gold, and platinum; alternatively, a substrate of a plastic coated with, e.g., a vapor-deposited layer of aluminum, aluminum alloy, indium oxide, tin oxide, or indium oxide-tin oxide; a plastic substrate or the above-mentioned electroconductive substrate coated with a mixture of an electroconductive powder such as titanium oxide, tin oxide, carbon black or silver powder and an appropriate binder; a plastic or paper substrate impregnated with an electroconductive powder; or a substrate comprising an electroconductive polymer.

Between the electroconductive substrate and the photosensitive layer, there may be formed a primer or undercoat layer having a barrier function and an adhesive function. The primer layer may be formed of, e.g., casein, polyvinyl alcohol, nitrocellulose, ethylene-acrylic acid copolymer, polyvinyl butyral, phenolic resin, polyamide (nylon 6, nylon 66, nylon 610, copolymer nylon, alkoxymethylated nylon) polyurethane, gelatin, or aluminum oxide.

The thickness of the primer layer should preferably be 0.1 to 4 μm, particularly 0.3 to 3 μm.

The charge generation layer may be produced by dispersing a charge-generating substance in an appropriate binder and applying the dispersion onto a substrate, followed by drying.

The charge-generating substance to be used in the present invention may include, for example, selenium-tellurium, yrylium, or thiopyrylium dye, a phthalocyanine type pigment, an anthanthrone pigment; a dibenzpyrene-quinone pigment, a pyranthrone pigment, a trisazo pigment, a disazo pigment, an azo pigment, an indigo pigment, a quinacridone type pigment, quinocyanine, an asymmetric quinocyanine, etc.

The charge generation layer should preferably be formed as a thin layer of, e.g., 5 μm or less, more preferably 0.01 to 1 μm in thickness so as to efficiently transport generated charge carriers to the boundary or interface between it and the charge transportation layer, or between it and the electroconductive substrate.

In order to disperse lubricant such as fluorine-containing resin powder, polyolefin resin powder, silicone resin powder or fluorinated carbon, there may be used a general dispersing means such as homogenizer, ultrasonic apparatus, ball mill, vibrating ball mill, sand mill, attritor or roll mill.

The above-mentioned lubricant may be added to a solution prepared by dissolving a binder in an appropriate solvent, and then may be dispersed in the solution by using the above-mentioned dispersion means. An appropriate amount of the resultant mixture may be further mixed with a solution prepared by dissolving a binder and a charge-transporting substance in a solvent, thereby to obtain a coating liquid for forming a surface layer which contains the above lubricant.

Further, in a case where the lubricant in the above coating liquid is liable to agglomerate or aggregate, as desired, a dispersing time or a solvent may be appropriately selected, or a dispersing aid may be added thereto.

The coating can be effected by various coating methods such as dip coating, spray coating, spinner coating, bead coating, wire bar coating, blade coating, roller coating, and curtain flow coating. The drying should preferably be conducted in the sequence of drying at room temperature to a "tack-free" state and then heat drying. The heat drying may be conducted for a time in the range of 5 minutes to 2 hours at a temperature of 30° C to 200° C under quienscent condition or under blowing.

Incidentally, in a case where a binder resin solution in which a lubricant having hydrophobicity such as fluorine-containing resin powder is dispersed, and a binder resin solution in which a charge-generating substance such as a considerably polar pigment is dispersed are mixed thereby to form a photosensitive layer as a single layer, since systems having mutually different characteristics are mixed, it is somewhat difficult to uniformly disperse the lubricant and the charge-generating substance thereby to stabilize the resultant mixture. Accordingly, in the present invention, the photosensitive layer may preferably comprise a laminated structure of the charge generation layer and the charge transportation layer.

The oxidation potential values referred to in the present invention are based on a measurement using a potential-sweeping method wherein a saturated calomel electrode was used as the reference electrode, and a 0.1 N solution of $(n\text{-}Bu)_4N^-C10_4^+$ in acetonitrile was used as the electrolytic solution.

More specifically, a sample was dissolved, at a concentration of about 5 - 10 mmol %, in an electrolytic solution of 0.1 N $(n\text{-}Bu)_4N^-C10_4^-$ in acetonitrile. Then, a voltage was externally applied to the resultant sample solution, and a change in current was measured while linearly changing the voltage from a low potential, thereby to obtain a current-potential curve. In the present invention, an oxidation potential is determined by the potential value corresponding to the first inflection point of the current value in the above-mentioned current-potential curve.

According to the present invention, not only mechanical durability of a photosensitive member surface to wear or scratches is improved, but also releasability to various stickings is imparted to the surface whereby the photosensitive member of the invention constantly provides a high-quality image without image blur and image flow.

The photosensitive member for electrophotography according to the present invention may be widely used not only for electrophotographic copying machines but also in the fields related to electrophotography such as laser printers, CRT printers, LED printers, and electrophotographic plate-making.

The present invention will be explained more specifically with reference to examples.

EXAMPLE 1

A 5% solution of a polyamide resin (a quaternary copolymer, Amilan CM-8000, mfd. by Toray K. K.) in methanol was applied on a substrate of an aluminum cylinder having a diameter of 80 mm and a length of 360 mm by dip coating and then dried thereby to form a 1 μm-thick primer layer.

Next, 10 parts (parts by weight, the same also hereinafter) of a disazo pigment represented by the following structural formula, and 6 parts of a polyvinyl butyral resin (butyral degree: 60 mol %, weight-average molecular weight: 30,000, S-LEC BXL, mfd. by Sekisui Kagaku K.K.) were dispersed in 100 parts by cyclohexane by means of a sand mill using 1 mm-diameter glass beads, for 20 hours.

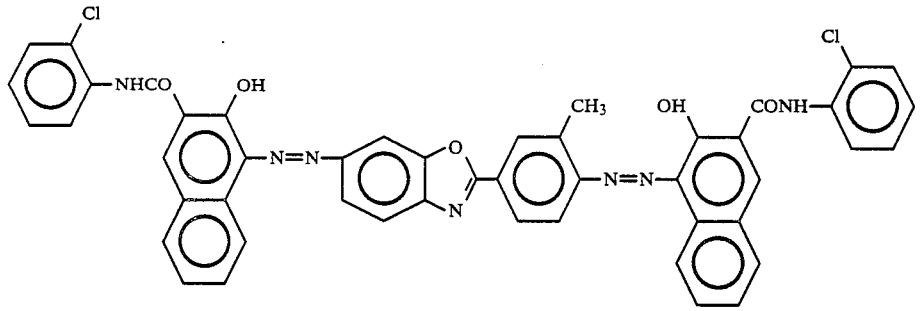

To the resultant dispersion, an appropriate amount (50 - 100 parts) of tetrahydrofuran was added, and then the dispersion was applied on the primer layer and dried at 100° C for 5 minutes thereby to form a 0.15 μm-thick charge generation layer.

Separately, polytetrafluoroethylene resin powder (fluorine-containing resin powder) having an average particle size (primary particles) of 0.3 μm as a lubricant, Compound Examples (1) - (10) of the charge-transporting substance having an oxidation potential of 0.6 V or above, as shown in the following Table 1, and a bisphenol Z-type polycarbonate resin (viscosity-average molecular weight: 25,000, mfd. by Teijin Kasei K.K.) as a binder were respectively provided.

TABLE 1

| No. | Structural formulas of Compound Examples | Oxidation potential (V) |
|---|---|---|
| (1) | 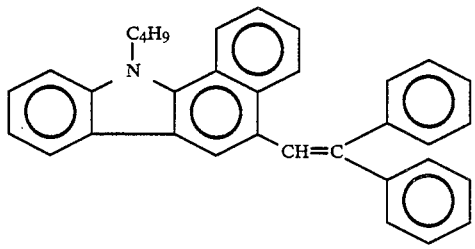 | 0.92 |
| (2) | 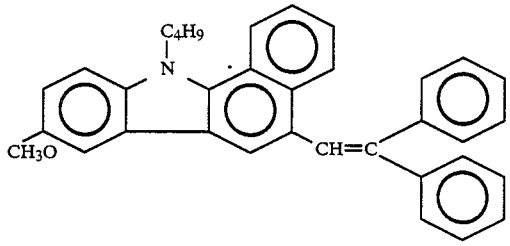 | 0.88 |
| (3) | 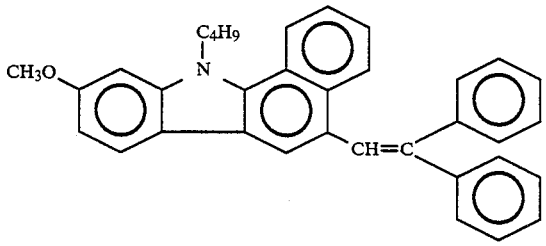 | 0.83 |
| (4) | 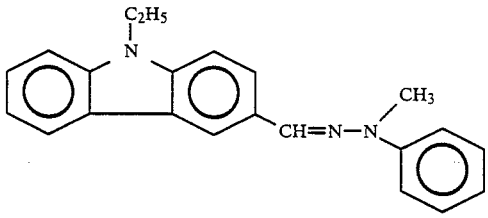 | 0.81 |

TABLE 1-continued
| No. | Structural formulas of Compound Examples | Oxidation potential (V) |
|---|---|---|
| (5) | 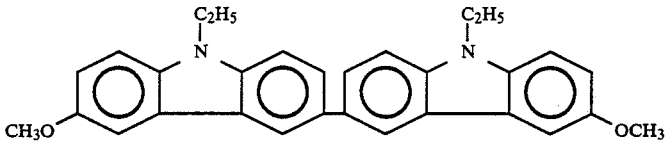 | 0.79 |
| (6) | 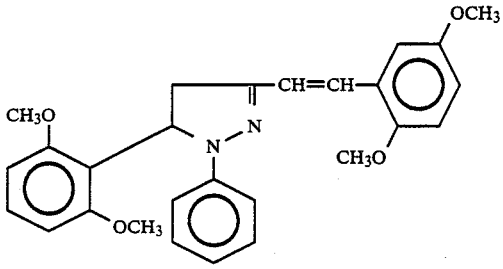 | 0.70 |
| (7) | 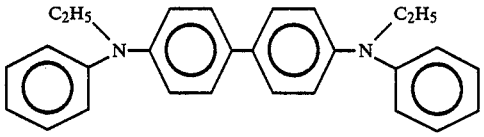 | 0.70 |
| (8) | 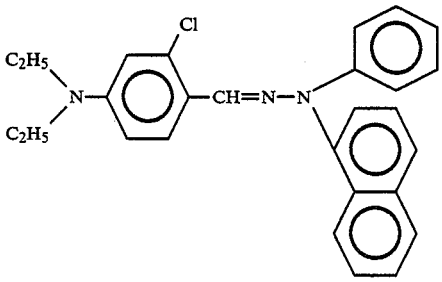 | 0.67 |
| (9) | 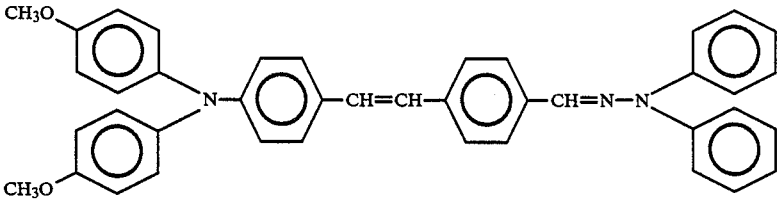 | 0.65 |
| (10) | 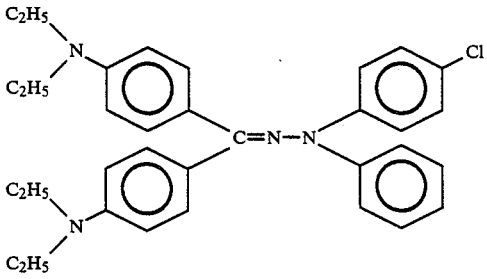 | 0.60 |

TABLE 1-continued

| No. | Structural formulas of Compound Examples | Oxidation potential (V) |
|---|---|---|
| (11) | 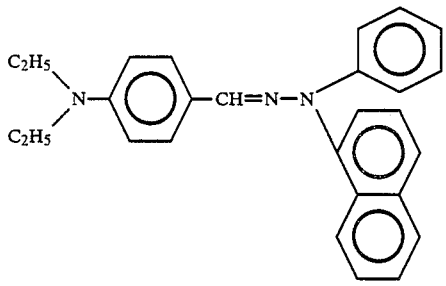 | 0.57 |
| (12) | 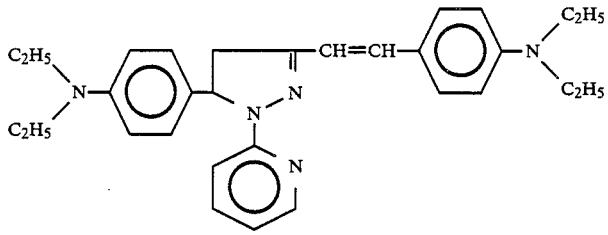 | 0.54 |
| (13) | 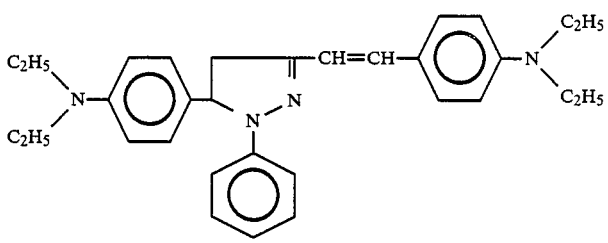 | 0.47 |

First, 20 parts of the above-mentioned polycarbonate resin and 20 parts of each Compound Examples (1) - (10) were respectively dissolved in 100 parts of cyclohexane, and to the respective resultant solutions 6 parts of the above-mentioned polytetrafluoroethylene powder was added and dispersed by means of a stainless ball mill for 50 hours. Further, 20 parts of dichloroethane was added to the respective resultant mixtures thereby to prepare coating liquids for charge transportation layers. The thus prepared coating liquids were respectively applied on the charge generation layer prepared above, and then dried by hot air at 100° C for 90 minutes, to respectively form 20 μm-thick charge transportation layers, thereby to prepare Photosensitive member Examples 1 - 10, respectively.

The thus prepared Photosensitive Member Examples 1 - 10 were respectively assembled in an electrophotographic copying machine, (NP-3525, mfd. by Canon K. K.) provided with a corona charger, an exposure optical system, a developing device, a transfer charger, a discharging exposure optical system and a blade cleaner, whereby image quality, mechanical durability and successive copying characteristics of the Photosensitive Member Examples were evaluated. The above copying machine used in this evaluation had been so modified that a cleaning blade contacted the photosensitive member to provide a hypothetical depth of penetration of 1.0 mm, into which the tip of the blade could reach as measured from the surface of the photosensitive member if the flexible blade could have been disposed without flexure, i.e., without being obstructed by the surface of the photosensitive member, and that the ratio of the circumferential speed of a sponge roller to that of the photosensitive member was set to 106%.

In cases where the Photosensitive Member Examples 1 to 7 were used, no image blur was caused and high-quality copied images were obtained even after successive copying of 200,000 sheets. Further, in these cases, the decreases in the thickness of the photosensitive layers were about 1.5 μm.

Herein, the above decreases in the photosensitive layer thickness were measured by means of an apparatus for measuring a thin-film thickness (mfd. by KETT) in which eddy current was used.

On the other hand, in cases where the Photosensitive Member Examples 8 to 10 were used, no image blur was caused and high-quality copied images were obtained even after successive copying of 80,000 sheets. Further, in these cases, the decreases in the thickness of the photosensitive layers were about 0.5 μm.

Further, the above-mentioned Photosensitive Member Examples 1 - 10 were used in successive copying of 10,000 sheets under high temperature-high humidity (32.5° C, 90% RH) conditions. As a result, image flow was not caused at all, and high-quality images were obtained.

COMPARATIVE EXAMPLE 1

Comparative Photosensitive Member Examples 1 to 3 were prepared in the same manner as in Example 1 except that Compound Examples (11) to (13) having an oxidation potential of below 0.6 V were respectively used, and image quality, mechanical durability and successive copying characteristics of the Comparative Photosensitive Member Examples were evaluated.

As a result, image blur was caused at the time of 8,000 sheet copying (Comparative Photosensitive Member Example 1), at the time of 6,000 sheet copying (Comparative Photosensitive Member Example 2), and at the time of 2,000 sheet copying (Comparative Photosensitive Member Example 3), respectively. In these cases, the decreases in the thickness of the photosensitive layers were all 0.5 μm or below (detection limit).

EXAMPLE 2

Photosensitive Member Examples 11 to 14 were respectively prepared in the same manner as in Example 1 except that polyvinylidene fluoride resin powder (average particle size of primary particles: 0.6 μm) was used in place of the polytetrafluoroethylene resin powder, and that Compound Examples (3), (7), (8) and (10) were respectively used as the charge transporting substance, and image quality, mechanical durability and successive copying characteristics of the Photosensitive Member Examples were evaluated.

In cases where the Photosensitive Member Examples 11 and 12 were used, no image blur was caused and high-quality copied images were obtained even after successive copying of 200,000 sheets. Further, in these cases, the decreases in the thickness of the photosensitive layers were about 1.5 μm.

On the other hand, in cases where the Photosensitive Member Examples 13 and 14 were used, no image blur was caused and high-quality copied images were obtained even after successive copying of 80,000 sheets. Further, in these cases, the decreases in the thickness of the photosensitive layers were about 0.5 μm.

COMPARATIVE EXAMPLE 2

10 parts of each of Compound Examples (1), (3), (7) and (8), and 10 parts of a bisphenol Z-type polycarbonate resin (mfd. by Teijin Kasei K.K.) were respectively dissolved in 70 parts of dichloromethane thereby to prepare coating solutions. The coating solutions were respectively applied on a drum provided with a primer layer and a charge generation layer respectively formed in the above-described manner, and then dried by hot air at 100° C for 90 minutes to respectively form 20 μ-thick charge transportation layers, thereby to prepare Comparative Photosensitive Member Examples 4 – 7, respectively.

The thus prepared Comparative Photosensitive Member Examples 4 – 7 were respectively assembled in an electrophotographic copying machine, which had been modified as described above, and mechanical durability and successive copying characteristics of the Comparative Photosensitive Member Examples were evaluated under high temperature-high humidity (32.5° C, 90% RH) conditions. As a result, image flow was caused in these cases after about 5,000 sheets of copying, since the thus prepared photosensitive layers had no releasability and paper powder attached to the surfaces thereof were difficult to be removed therefrom.

EXAMPLE 3

Photosensitive Member Examples 15 to 18 were respectively prepared in the same manner as in Example 1 except that a polymethyl methacrylate resin (weight-average molecular weight: 300,000, Dianal BR-85, mfd. by Mitsubishi Rayon K.K.)) was used as a binder in place of the bisphenol Z-type polycarbonate resin, and that Compound Examples (2), (4), (6) and (8) were respectively used as the charge-transporting substance, and image quality, mechanical durability and successive copying characteristics of the Photosensitive Member Examples were evaluated.

In all cases, no image blur was caused and high-quality copied images were obtained even after successive copying of 80,000 sheets.

COMPARATIVE EXAMPLE 3

Comparative Photosensitive Member Examples 8 – 11 were respectively prepared in the same manner as in Comparative Example 2 except that the polymethyl methacrylate resin used in Example 3 was used as a binder in place of the bisphenol Z-type polycarbonate resin.

The thus prepared Comparative Photosensitive Member Examples were respectively assembled in an electrophotographic copying machine which has been modified as mentioned above, and mechanical durability and successive copying characteristics of the Comparative Photosensitive Member Examples were evaluated under high temperature-high humidity (32.5° C, 90% RH) conditions. As a result, image flow was caused in all cases after about 4,000 sheets of copying.

EXAMPLE 4

10 parts of the disazo pigment used in Example 1, and 10 parts of bisphenol A-type polycarbonate (viscosity-average molecular weight: 30,000, Iupilon S-2000, mfd. by Mitsubishi Gas Chemical K. K.) were dispersed in a mixture of 50 parts of dichloromethane and 50 parts of tetrahydrofuran by means of a sand mill using 1 mm-diameter glass beads for 20 hours, thereby to prepare a disazo pigment dispersion.

Separately, 20 parts of the above polycarbonate resin and 20 parts of Compound Example (3) as a charge-transporting substance were dissolved in a mixture of 50 parts of dichloromethane and 50 parts of tetrahydrofuran, and 6 parts of tetrafluoroethylene resin powder was further added to the resultant solution and then dispersed by means of a stainless ball mill for 50 hours, thereby to prepare a lubricant dispersion.

The thus prepared lubricant dispersion was mixed with the disazo pigment dispersion prepared above, thereby to prepare a coating liquid for a photosensitive layer.

The coating liquid was applied on an aluminum cylinder which had been provided with a primer layer in the same manner as in Example 1, and then dried at 100° C for 60 minutes to form a 20 μm-thick photosensitive layer, thereby to prepare Photosensitive Member Example 19.

Image quality, mechanical durability and successive copying characteristics of Photosensitive Member Example 19 were evaluated in the same manner as in Example 1. As a result, no image blur was caused and high-quality copied images were obtained even after successive copying of 200,000 sheets.

EXAMPLE 5

Photosensitive Member Examples 20 to 24 were respectively prepared in the same manner as in Example 1 except that polyethylene resin powder (polyolefin resin powder, average particle size of primary particles: 2 μm) was used as a lubricant in place of the polytetrafluoroethylene resin powder, and that Compound Examples (1), (3), (7), (8) and (10) were respectively used as charge-transporting substances.

Separately, Comparative Photosensitive Member Examples 12 to 14 were respectively prepared in the same manner as in Example 1 except that the above polyethylene resin powder was used and that Compound Examples (11), (12) and (13) were respectively used as charge-transporting substances.

Image quality, mechanical durability and successive copying characteristics of the Photosensitive Member Examples and Comparative Photosensitive Member Examples were evaluated in the same manner as in Example 1.

In cases where the Photosensitive Member Examples 20 to 22 were used, no image blur was caused and high-quality copied images were obtained even after successive copying of 200,000 sheets. Further, in these cases, the decreases in the thickness of the photosensitive layers were about 2 μm.

In cases where the Photosensitive Member Examples 23 and 24 were used, no image blur was caused and high-quality copied images were obtained even after successive copying of 80,000 sheets. Further, in these cases, the decreases in the thickness of the photosensitive layers were about 1 μm.

On the other hand, in cases where Comparative Photosensitive Member Examples 12, 13 and 14 were used, image blur was caused at the time of 7,000 sheets copying (Comparative Photosensitive Member Example 12), at the time of 5,500 sheet copying (Comparative Photosensitive Member Example 13), and at the time of 2,000 sheets copying (Comparative Photosensitive Member Example 14), respectively. In these cases, the decreases in the thickness of the photosensitive layers were all 0.5 μm or below (detection limit).

Further, the above-mentioned Photosensitive Member Examples 20 to 22 were used in successive copying of 10,000 sheets under high temperature-high humidity (32.5° C, 90% RH) conditions. As a result, image flow was not caused at all, and high-quality images were obtained.

EXAMPLE 6

Photosensitive Member Examples 25 to 29 were respectively prepared in the same manner as in Example 1 except that silicone resin powder (average particle size of primary particles: 2 μm) was used as a lubricant in place of the polytetrafluoroethylene resin powder, and that Compound Examples (1), (3), (7), (8) and (10) were respectively used as charge-transporting substances.

Separately, Comparative Photosensitive Member Examples 15 to 17 were respectively prepared in the same manner as in Example 1 except that the above silicone resin powder, and that Compound Examples (11), (12) and (13) were respectively used as charge-transporting substances.

Image quality, mechanical durability and successive copying characteristics of the thus prepared Photosensitive Member Electrodes and Comparative Photosensitive Member Examples were evaluated in the same manner as in Example 1.

In cases where the Photosensitive Member Examples 25 to 27 were used, no image blur was caused and high-quality copied images were obtained even after successive copying of 200,000 sheets. Further, in these cases, the decreases in the thickness of the photosensitive layers were about 2 μm. In cases where the Photosensitive Member Examples 28 and 29 were used, no image blur was caused and high-quality copied images were obtained even after successive copying of 80,000 sheets. Further, in these cases, the decreases in the thickness of the photosensitive layers were about 1 μm.

On the other hand, in cases where Comparative Photosensitive Member Examples 15, 6 and 17 were used, image blur was caused at the time of 6,500 sheets copying (Comparative Photosensitive Member Example 15), at the time of 5,500 sheets copying (Comparative Photosensitive Member Example 16), and at the time of 2,000 sheets copying (Comparative Photosensitive Member Example 17), respectively. In these cases, the decreases in the thickness of the photosensitive layers were all 0.5μm or below (detection limit).

Further, the above-mentioned Photosensitive Member Examples 25 to 29 were used in successive copying of 10,000 sheets under high temperature-high humidity (32.5° C, 90% RH) conditions. As a result, image flow was not caused at all, and high-quality images were obtained.

EXAMPLE 7

Photosensitive Member Examples 30 to 34 were respectively prepared in the same manner as in Example 1 except that fluorinated carbon (average particle size of primary particles: 5 μm) was used as a lubricant in place of the polytetrafluoroethylene resin powder, and that Compound Examples (1), (3), (7), (8) and (10) were respectively used as charge-transporting substances.

Separately, Comparative Photosensitive Member Examples 18 to 26 were respectively prepared in the same manner as in Example 1 except that the above fluorinated carbon was used and that Compound Examples (11), (12) and (13) were respectively used as charge-transporting substances.

Image quality, mechanical durability and successive copying characteristics of the Photosensitive Member Examples and Comparative Photosensitive Member Examples were evaluated in the same manner as in Example 1.

In cases where the Photosensitive Member Examples 30 to 32 were used, no image blur was caused and high-quality copied images were obtained even after successive copying of 200,000 sheets. Further, in these cases, the decreases in the thickness of the photosensitive layers were about 2.5 μm.

In cases where the Photosensitive Member Examples 33 and 34 were used, no image blur was caused and high-quality copied images were obtained after successive copying of 80,000 sheets. Further, in these cases, the decreases in the thickness of the photosensitive layers were about 1 μm.

On the other hand, in cases where Comparative Photosensitive Member Examples 18, 19 and 20 were used, image blur was caused at the time of 6,000 sheets copying (Comparative Photosensitive Member Example 18), at the time of 4,000 sheets copying (Comparative Photosensitive Member Example 19), and at the time of 2,000 sheets copying (Comparative Photosensitive Member Example 20), respectively. In these cases, the decreases in the thickness of the photosensitive layers were all 0.5 μm or below (detection limit).

Further, the above-mentioned Photosensitive Member Examples 30 to 34 were used in successive copying of 10,000 sheets under high temperature-high humidity (32.5° C, 90% RH) conditions. As a result, image flow was not caused at all, and high-quality images were obtained.

EXAMPLE 8

There were provided polytetrafluoroethylene resin powder (fluorine-containing resin powder, average particle size of primary particles: 0.3 μm) as a lubricant, Compound Examples (1) to (10) of the charge-transporting substance having an oxidation potential of 0.6 V or above as shown in Table 1, a bisphenol Z-type polycarbonate (viscosity-average molecular weight: 25,000) as a binder, and a dispersant represented by the following structural formula (number-average molecular weight: about 10,000, composition weight ratio: A/B=7/3, n≈4 to 8).

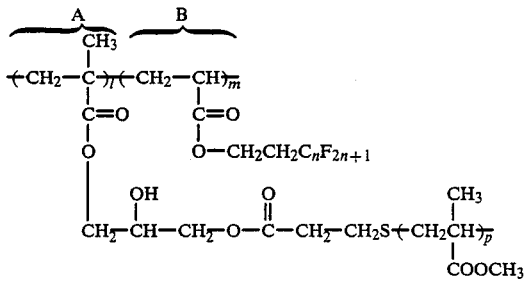

First, 20 parts of the above-mentioned polycarbonate resin and 20 parts of each Compound Examples (1) - (10) were respectively dissolved in 100 parts of cyclohexane, and to the respective resultant solutions 6 parts of the above-mentioned polytetrafluoroethylene powder and 0.8 part of the dispersant were added, and dispersed by means of a stainless ball mill for 20 hours. Further, 20 parts of dichloroethane was added to the respective resultant mixtures thereby to prepare coating liquids for a charge transportation layer. The thus prepared coating liquids were respectively applied on the charge generation layer which has been formed on a primary layer in the same manner as in Example 1, and then dried by hot air at 100° C for 90 minutes, to respectively form 20 μm-thick charge transportation layers, thereby to prepare Photosensitive Member Examples 35 to 44, respectively.

The thus obtained Photosensitive Member Examples 35 - 44 were respectively assembled in an electrophotographic copying machine (NP-3525, mfd. by Canon K. K.) which had been so modified that it could be equipped with a probe for potential measurement in the cleaner section thereof.

By using the above copying machine, a dark part potential ($V_D$) and a light part potential ($V_L$) after an exposure to light of 3 lux. sec. were respectively measured. Then, after successive copying operations were effected, $V_D$ and $V_L$ after successive copying were measured similarly as mentioned above.

The results are shown in the following Table 2.

TABLE 2

| Photosensitive Member Example No. | Before successive copying $V_D$(−V) | Before successive copying $V_L$(−V) | After successive copying $V_D$(−V) | After successive copying $V_L$(−V) |
|---|---|---|---|---|
| 35 | 700 | 120 | 685 | 190 |
| 36 | 705 | 125 | 680 | 200 |
| 37 | 700 | 120 | 690 | 205 |
| 38 | 710 | 135 | 695 | 225 |
| 39 | 695 | 130 | 690 | 220 |
| 40 | 700 | 130 | 685 | 225 |
| 41 | 705 | 135 | 685 | 230 |
| 42 | 715 | 145 | 710 | 215 |

TABLE 2-continued

| Photosensitive Member Example No. | Before successive copying $V_D$(−V) | Before successive copying $V_L$(−V) | After successive copying $V_D$(−V) | After successive copying $V_L$(−V) |
|---|---|---|---|---|
| 43 | 700 | 140 | 685 | 215 |
| 44 | 690 | 145 | 680 | 225 |

With respect to the above potentials $V_D$ and $V_L$ after successive copying, those after 200,000 sheets of copying are shown in cases of Photosensitive Member Examples 35 to 41, and those after 80,000 sheets of copying are shown in cases of Photosensitive Member Examples 42 to 44. Further, the decreases in the photosensitive layer thickness were about 1.5 μm in cases of Photosensitive Member Examples 35 to 41, and those decreases were about 0.5 μm in cases of Photosensitive Member Examples 42 to 44.

As shown in Table 2, the decreases in the photosensitive layer thickness were small and the changes in $V_D$ were extremely small, since the polytetrafluoroethylene resin powder was dispersed in the surface portions of the above Photosensitive Member Examples. Further, since the charge-transporting substances having a high oxidation potential were used, the deterioration thereof were little whereby the changes in $V_L$ were also small.

What is claimed is:

1. A photosensitive member for electrophotography comprising a photosensitive layer, at least the surface portion of which comprises a lubricant powder, and a charge-transporting substance having an oxidation potential of 0.6 volt or above.

2. A photosensitive member according to claim 1, wherein said photosensitive layer comprises a charge generation layer and a charge transportation layer disposed thereon, said charge transportation layer comprising the lubricant powder, and the charge-transporting substance having an oxidation potential of 0.6 volt or above.

3. A photosensitive member according to claim 1, wherein said photosensitive layer contains a charge-generating substance.

4. A photosensitive member according to claim 2, wherein said lubricant powder is lubricative resin powder.

5. A photosensitive member according to claim 1 or 2, wherein said lubricant powder is selected from the group consisting of fluorine-containing resin powder, polyolefin resin powder, silicone resin powder and fluorinated carbon.

6. A photosensitive member according to claim 1 or 2, wherein said lubricant powder is fluorine-containing resin powder.

7. A photosensitive member according to claim 6, wherein said fluorine-containing resin powder is selected from the group consisting of tetrafluoroethylene resin powder and vinylidene fluoride resin powder.

8. A photosensitive member according to claim 2, wherein said lubricant powder is polyolefin resin powder.

9. A photosensitive member according to claim 8, wherein said polyolefin resin powder is selected from the group consisting of polyethylene resin powder and polypropylene resin powder.

10. A photosensitive member according to claim 1, wherein the lubricant powder content in said photosensitive layer is 1 - 50 wt. %.

11. A photosensitive member according to claim 2, wherein the lubricant powder content in said charge transportation layer is 1 - 50 wt. %.

12. A photosensitive member according to claim 1 or 2, wherein said charge-transporting substance has an oxidation potential of 0.7 volt or above.

13. A photosensitive member according to claim 2, wherein said charge transportation layer contains a polycarbonate resin as a binder.

14. A photosensitive member according to claim 1, wherein the charge-transporting substance is selected from the group consisting of hydrazone compounds, stilbene-type compounds, carbazole compounds, pyrazoline compounds, oxazole compounds, thiazole compounds, triarylmethane compounds and polyaryl alkanes.

* * * * *